US006252163B1

(12) United States Patent
Fujimori et al.

(10) Patent No.: US 6,252,163 B1
(45) Date of Patent: Jun. 26, 2001

(54) CONNECTING CABLE, COMMUNICATIONS DEVICE AND COMMUNICATION METHOD

(75) Inventors: Takahiro Fujimori, Tokyo; Kazuo Yoshino, Aichi; Yasuo Kusagaya, Tokyo, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 08/975,409

(22) Filed: Nov. 20, 1997

(30) Foreign Application Priority Data

Nov. 22, 1996 (JP) ..... 8-311726

(51) Int. Cl.[7] ..... H01B 11/06
(52) U.S. Cl. ..... 174/36; 439/620
(58) Field of Search ..... 174/27, 32, 33, 174/36, 250; 439/620; 333/12, 182

(56) References Cited

U.S. PATENT DOCUMENTS

| | | | | |
|---|---|---|---|---|
| 2,119,853 | * | 6/1938 | Curtis | 174/27 |
| 4,506,235 | * | 3/1985 | Mayer | 333/12 |
| 4,950,185 | * | 8/1990 | Boutros | 439/620 |
| 5,023,577 | * | 6/1991 | Drake | 439/620 X |
| 5,346,410 | | 9/1994 | Moore, Jr. | 439/607 |
| 5,357,051 | * | 10/1994 | Hwang | 174/250 X |
| 5,523,728 | | 6/1996 | McCorkle | 333/128 |
| 5,639,264 | * | 6/1997 | Belopolsky et al. | 439/620 |
| 5,831,210 | * | 11/1998 | Nugent | 174/27 |

FOREIGN PATENT DOCUMENTS

| | | | |
|---|---|---|---|
| 3-78984 | * | 4/1991 | (JP) . |
| WO 97 18586 | | 5/1997 | (WO) . |

OTHER PUBLICATIONS

Patent Abstracts of Japan, vol. 017, No. 071 (E–1319), Feb. 12, 1993 & JP 04 275070 A (Hitachi Medical Corp.), Sep. 30, 1992.

* cited by examiner

*Primary Examiner*—Dean A. Reichard
*Assistant Examiner*—Chau N. Nguyen
(74) *Attorney, Agent, or Firm*—Frommer Lawrence & Haug, LLP.; William S. Frommer; Glenn F. Savit

(57) ABSTRACT

In a 6-pin cable according to an IEEE-1394 standard, power lines and two pairs of signal conductors are built and connected to a head part provided with six electric joints corresponding to six conductors (total six two power lines and total four signal conductors). Ferrite beads respectively forming a closed magnetic circuit around the signal conductors are respectively provided to the signal conductors of the 6-pin cable. As a result, crosstalk between the signal conductors in a common mode is inhibited.

26 Claims, 17 Drawing Sheets

| PIN NO. | SIGNAL |
|---|---|
| 1 | TPB* |
| 2 | TPB |
| 3 | TPA* |
| 4 | TPA |

| PIN NO. | SIGNAL |
|---|---|
| 1 | VP |
| 2 | VG |
| 3 | TPB* |
| 4 | TPB |
| 5 | TPA* |
| 6 | TPA |

CONNECTING CABLE, COMMUNICATIONS DEVICE AND COMMUNICATION METHOD

BACKGROUND OF THE INVENTION

1. Field of the Invention

The present invention relates to a connecting cable, a communication device and a communication method, particularly relates to a connecting cable in which an independent closed magnetic circuit interlinked with each signal conductor and formed by material provided with high magnetic permeability and predetermined magnetic reluctance is arranged for inhibiting crosstalk between signal conductors caused by the in-phase component of signals on two signal conductors, a communication device and a communication method.

2. Description of the Related Art

Recently, a device utilizing an interface according to the IEEE-1394–1995 high performance serial bus standard (an IEEE-1394 bus) for an interface for connecting plural information processors such as a computer and a video terminal is proposed.

FIG. 23 shows an example of an information processing system constituted by plural information processors which are respectively connected utilizing an interface according to the IEEE-1394–1995 standard (hereinafter, "IEEE-1394").

The above information processing system is constituted by a workstation 101, a personal computer 102, a hard disk 103, a printer 104, a scanner 105, an electronic camera 106 and a compact disc (CD)-ROM drive 107 respectively provided with an interface according to the IEEE-1394 standard.

The workstation 101 to the scanner 105 are respectively connected in a daisy chain mode via 1394 cables 111-1 to 111-4 according to the IEEE-1394 standard, and the electronic camera 106 and the CD-ROM drive 107 are respectively connected to the workstation 101 in a tree structure mode via 1394 cables 111-5 and 111-6.

FIG. 24 shows an example in which predetermined two devices 141A and 141B of the above workstation 101 to the CD-ROM drive 107 are connected.

The 1394 cable 111 is a cable according to the IEEE-1394 standard provided with two pairs of twisted pair signal conductors 12 and 13 (further provided with two power lines not shown in the case of a 6-pin cable) and provided with a 4- or 6-pin plug 125-1 or 125-2 at each end.

FIG. 25 shows an example (in the case of a 6-pin cable) of the section of the 1394 cable 111. As shown in FIG. 25, signal conductor shields 17-1 and 17-2 are respectively provided to each signal conductor 12 or 13 in the 1394 cable 111 and a whole cable shield 18 is provided outside the signal conductors 12 and 13 and the power lines 11-1 and 11-2.

The devices 141A and 141B shown in FIG. 24 are respectively provided with twisted pair A (TPA) interfaces 151A and 151B and twisted pair B (TPB) interfaces 152A and 152B respectively which are a part of an IEEE-1394 interface.

The TPA interfaces 151A and 151B and the TPB interfaces 152A and 152B respectively send/receive a signal between the two devices 141A and 141B and also respectively send/receive the arbitration information of cables determined in the IEEE-1394 standard and supplied from a predetermined device.

Further, the TPB interfaces 152A and 152B respectively supply a d.c. signal of voltage corresponding to any of plural types of maximum transfer rates determined in the IEEE-1394 standard to the TPA interfaces 151B and 151A of each connected device.

FIG. 26 shows an example of the electric constitution of each TPA interface 151A and 151B.

After a driver 161 amplifies a strobe pulse (Strb_Tx) corresponding to transmitted data when a strobe enabling signal (Strb_Enable) is supplied, the driver sends the amplified strobe pulse as a TPA signal via one of the two conductors of the signal conductor 12 or 13 and sends a signal generated by inverting a TPA signal as a TPA* signal via the other conductor of the same signal conductor.

For example, the driver 161 of the TPA interface 151A in the device 141A shown in FIG. 24 sends a TPA signal and a TPA* signal via the signal conductor 12.

An interface according to the IEEE-1394 standard adopts a DS linking system for encoding in data transmission. In the DS linking system, as shown in FIG. 27, predetermined data is transmitted on one signal conductor and a strobe pulse generated to change the value of the data when it is unchanged is transmitted on the other signal conductor. A clock pulse can be obtained by calculating the exclusive-OR of data and a strobe pulse.

A receiver 162 operates difference between signals transmitted via the two conductors of the signal conductor 12 or 13 and after the receiver amplifies the operated result, it outputs the amplified operated result as received data.

Arbitration comparators 163-1 and 163-2 respectively operate difference between signals corresponding to arbitration information and transmitted via the two conductors of the signal conductor as data, respectively judge whether a value showing the operated result is larger than a predetermined threshold value or not and respectively output a value corresponding to the judgement as received arbitration information.

A buffer 164 supplies predetermined reference voltage TpBias to a comparator 165.

The comparator 165 is provided with plural comparing sections not shown, compares the voltage value of a d.c. signal corresponding to the maximum transfer rate transmitted in a common mode (a mode in which a TPA signal and a TPA* signal are in phase) via the signal conductor 12 or 13 and preset reference voltage corresponding to plural maximum transfer rates (for example, 400 Mbps, 200 Mbps and 100 Mbps), and outputs the result of the comparison (the information of the maximum transfer rate of the connected device).

FIG. 28 shows an example of the electric constitution of the TPB interfaces 152A and 152B.

After a driver 171 amplifies a data signal (Data_Tx) to be transmitted when a data enabling signal (Data_Enable) is supplied, the driver sends the amplified data signal as a TPB signal via one of the two conductors the signal conductor 12 or 13 and also sends a signal generated by inverting a TPB signal as a TPB* signal via the other conductor of the same signal conductor.

A receiver 172 operates difference between signals transmitted via the two conductors of the signal conductor 12 or 13 and after the receiver amplifies the operated result, it outputs the amplified operated result as a received strobe pulse.

Arbitration comparators 174-1 and 174-2 respectively operate difference between signals corresponding to arbitration information and transmitted via the two conductors of the signal conductor 12 or 13 as data, respectively judge whether a value of the operated result is larger than a predetermined threshold value or not and respectively output a value corresponding to the judgement as received arbitration information.

A cable connection comparator 175 detects a voltage value varied because the cable 111 is connected and outputs the detected result.

When a signal (Speed_Tx) corresponding to the maximum transfer rate of a device in which constant current circuits 173-1 and 173-2 are built is supplied, the constant current circuits output current corresponding to the signal, generate predetermined voltage which is in phase (in a common mode) as a TPB signal and a TPB* signal and execute speed signaling processing.

Next, communication between the devices 141A and 141B shown in FIG. 24 will be described.

In the devices 141A and 141B connected via an interface according to the IEEE-1394 standard, first when a path is reset, the respective connected devices are informed in a common mode about the maximum transfer rate of the respective devices as speed signaling processing.

At this time, the TPB interfaces 152A and 152B of each device similarly apply voltage corresponding the maximum transfer rate of each device to the signal conductors 12 and 13 respectively in the constant current circuits 173-1 and 173-2 and when the TPA interfaces 151B and 151A of the devices connected to the above each device detect respective voltage values in the comparator 165, the devices connected to the above each device are informed about the maximum transfer rate of each device.

After each device is informed about the maximum transfer rate as described above, it starts the sending of data at the slowest transfer rate of preset plural transfer rates.

When data is sent, the driver 171 of the TPB interfaces 152A and 152B of each device sends data via one signal conductor and the driver 161 of the TPA interfaces 151A and 151B sends a strobe pulse corresponding to the data via the other signal conductor. The receiver 162 of the TPA interfaces 151B and 151A of the devices connected to each device receives a transmitted data signal and the receiver 172 of the TPB interfaces 152B and 152A receives a transmitted strobe pulse.

As described above, predetermined data and a strobe pulse corresponding to it are transmitted from one device to the other device according to the DS linking system.

However, there is a problem that as a magnetic flux interlinked with another signal conductor is increased of magnetic fluxes generated due to a transmitted signal in case a signal is transmitted in a common mode as in the above speed signaling processing, crosstalk between signal conductors is increased and a malfunction may occur in each device.

For example, a signal in a common mode sent from the TPB interface 152A in the device 141A shown in FIG. 24 via the signal conductor 13 is transmitted to the signal conductor 12 by electromagnetic induction, reaches the TPA interface 151A in the device 141A and the TPB interface 152B in the device 141B via the signal conductor 12 and crosstalk is caused.

SUMMARY OF THE INVENTION

The present invention is made in view of such a status and the object is to inhibit the above crosstalk by forming an independent closed magnetic circuit interlinked with each signal conductor by material provided with high magnetic permeability and predetermined magnetic reluctance.

A connecting cable disclosed in claim 1 is characterized in that closed magnetic circuit means in which a closed magnetic circuit interlinked with each pair of at least two pairs of signal conductors is formed by material provided with high magnetic permeability and predetermined magnetic reluctance is provided.

A communication device disclosed in claim 8 is characterized in that connection means provided with a closed magnetic circuit part in which a closed magnetic circuit interlinked with two conductors corresponding to each signal conductor is formed by material provided with high magnetic permeability and predetermined magnetic reluctance is provided.

A communication method disclosed in claim 11 is characterized in that communication is made via a connection provided with a closed magnetic circuit part which a closed magnetic circuit interlinked with two conductors corresponding to each signal conductor is formed by material provided with high magnetic permeability and predetermined magnetic reluctance.

A communication device disclosed in claim 12 is characterized in that processing means provided with a closed magnetic circuit part in which a closed magnetic circuit interlinked with two conductors corresponding to each signal conductor is formed by material provided with high magnetic permeability and predetermined magnetic reluctance is provided.

A communication method disclosed in claim 15 is characterized in that processing is executed by a processing section provided with a closed magnetic circuit part in which a closed magnetic circuit interlinked with two conductors corresponding to each signal conductor is formed by material provided with high magnetic permeability and predetermined magnetic reluctance.

A communication device disclosed in claim 16 is characterized in that a closed magnetic circuit part in which a closed magnetic circuit interlinked with two conductors corresponding to each signal conductor for connecting connection means and processing means is formed by material provided with high magnetic permeability and predetermined magnetic reluctance is provided.

A communication method disclosed in claim 19 is characterized in that a closed magnetic circuit part in which a closed magnetic circuit interlinked with two conductors corresponding to each signal conductor for connecting a connecting section and a processing section is formed by material provided with high magnetic permeability and predetermined magnetic reluctance is provided and communication is made via the conductors.

In the connecting cable disclosed in claim 1, for example, communication is made via each pair of at least two pairs of signal conductors interlinked with closed magnetic circuit means in which a closed magnetic circuit is formed by material provided with high magnetic permeability and predetermined magnetic reluctance.

In the communication device disclosed in claim 8, for example, communication is made via connection means provided with a closed magnetic circuit part in which a closed magnetic circuit interlinked with two conductors corresponding to each signal conductor is formed by material provided with high magnetic permeability and predetermined magnetic reluctance.

In the communication method disclosed in claim 11, for example, communication is made via a connecting section provided with a closed magnetic circuit part in which a closed magnetic circuit interlinked with two conductors corresponding to each signal conductor is formed by material provided with high magnetic permeability and predetermined magnetic reluctance.

In the communication device disclosed in claim 12, for example, processing means provided with a closed magnetic circuit part in which a closed magnetic circuit interlinked with two conductors corresponding to each signal conductor is formed by material provided with high magnetic permeability and predetermined magnetic reluctance executes communication processing.

In the communication method disclosed in claim 15, processing is executed by a processing section provided with a closed magnetic circuit part in which a closed magnetic circuit interlinked with two conductors corresponding to each signal conductor is formed by material provided with high magnetic permeability and predetermined magnetic reluctance.

In the communication device disclosed in claim 16, a closed magnetic circuit part in which a closed magnetic circuit interlinked with two conductors corresponding to each signal conductor for connecting connection means and processing means is formed by material provided with high magnetic permeability and predetermined magnetic reluctance is provided and communication is made via the conductors.

In the communication method disclosed in claim 19, a closed magnetic circuit part in which a closed magnetic circuit interlinked with two conductors corresponding to each signal conductor for connecting a connecting section and a processing section is formed by material provided with high magnetic permeability and predetermined magnetic reluctance is provided and communication is made via the conductors.

DESCRIPTION OF THE PREFERRED EMBODIMENTS

Figure 1B:
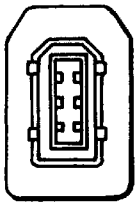
FIGS. 1A and 1B are plans showing a first embodiment of a connecting cable according to the present invention.
Figure 1A:
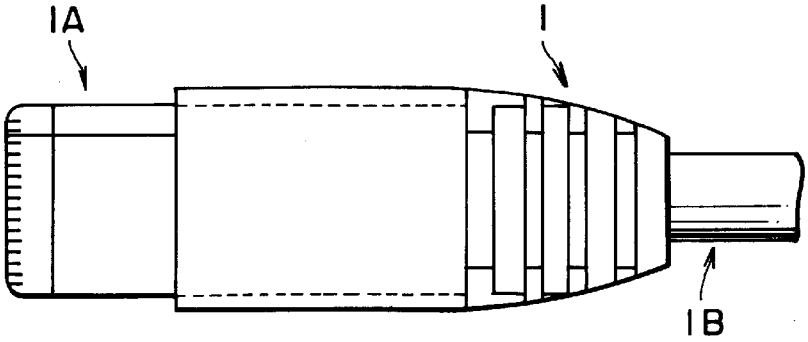

FIGS. 1A and 1B show a 6-pin cable equivalent to a first embodiment of a connecting cable according to the present invention. The 6-pin cable 1 is provided with a head part 1A and a cable part 1B respectively according to the IEEE-1394 standard.

Figure 2:
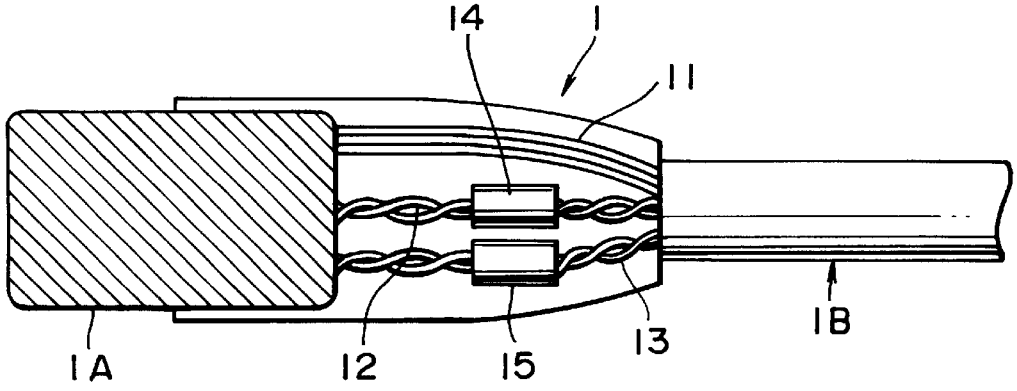
FIG. 2 is a sectional view showing an example of the constitution of the inside of the connecting cable shown in FIG. 1.

FIG. 2 shows an example of the constitution of the inside of a plug part of the 6-pin cable 1 shown in FIG. 1. In the 6-pin cable according to the IEEE-1394 standard, power lines 11 and two pairs of signal conductors 12 and 13 are connected to the head part 1A provided with six electric connections not shown corresponding to six conductors (total six consisting of the two power lines 11 and the total four of the signal conductors 12 and 13).

Ferrite beads 14 and 15 (closed magnetic circuit means) respectively forming an independent closed magnetic circuit around the signal conductors 12 and 13 are respectively provided to the signal conductors 12 and 13 of the 6-pin cable 1 shown in FIG. 1.

Figure 3B:
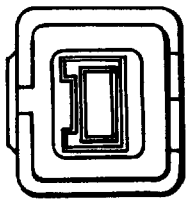
FIGS. 3A and 3B are plans showing a second embodiment of the connecting cable according to the present invention.
Figure 3A:
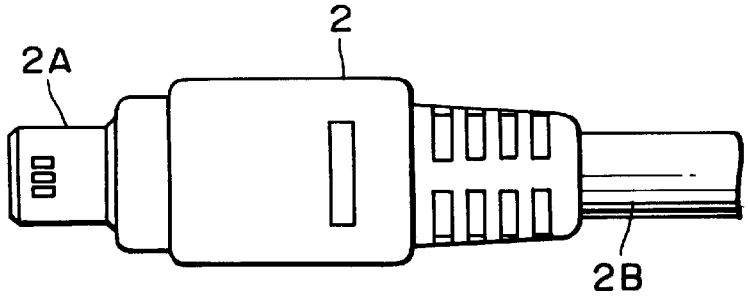

FIGS. 3A and 3B show a 4-pin cable equivalent to a second embodiment of the connecting cable according to the present invention. The 4-pin cable 2 is provided with a head part 2A and a cable part 2B respectively according to the IEEE-1394 standard.

Figure 4:
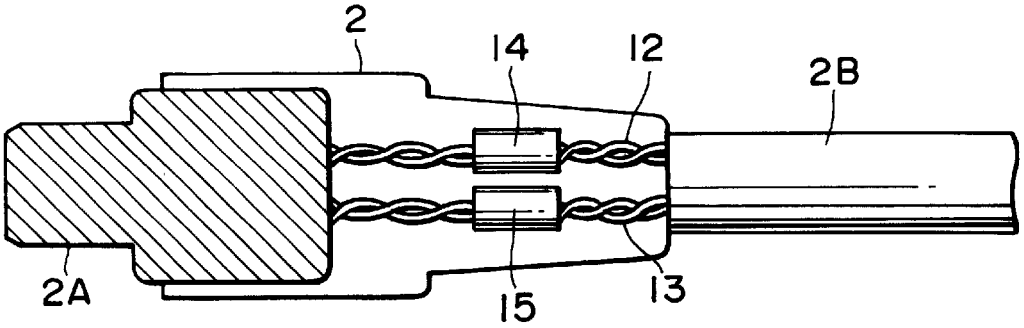
FIG. 4 is a sectional view showing an example of the constitution of the inside of the connecting cable shown in FIG. 3.

FIG. 4 shows an example of the inside constitution of a plug part of the 4-pin cable 2 shown in FIGS. 3A and 3B. In the 4-pin cable according to the IEEE-1394 standard, two pairs of signal conductors 12 and 13 are connected to the head part 2A provided with four electric connections not shown corresponding to four conductors (total four consisting of each two of the signal conductors 12 and 13).

As the 6-pin cable 1, ferrite beads 14 and 15 respectively forming a closed magnetic circuit around the signal conductors 12 and 13 are respectively provided to the signal conductors 12 and 13 of the 4-pin cable 2 shown in FIGS. 3A and 3B.

Figure 5A:
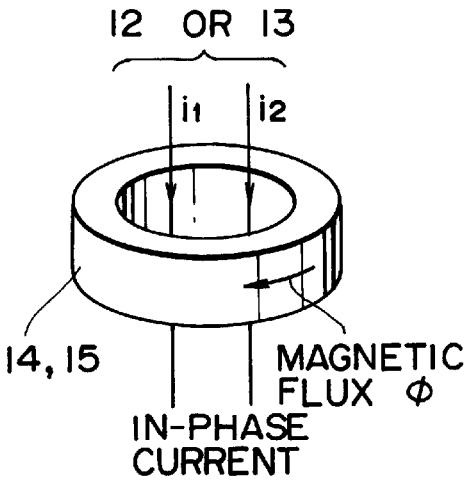
FIGS. 5A and 5B show an example of relationship between the direction of current on a signal conductor and a magnetic flux in a ferrite bead.

As shown in FIG. 5A, a magnetic flux is generated in a common mode because current in the two conductors of a predetermined signal conductor flows in the same direction by respectively providing the ferrite beads 14 and 15 to the signal conductors 12 and 13 as shown in FIGS. 2 and 4, however, as most magnetic fluxes respectively pass the ferrite beads 14 and 15 which are excellent in magnetic permeability, magnetic fluxes interlinked with a different signal conductor are small and further, as particularly, energy in a high-frequency area is converted to heat energy and absorbed because of the internal loss of ferrite, the above crosstalk is inhibited.

Figure 5B:
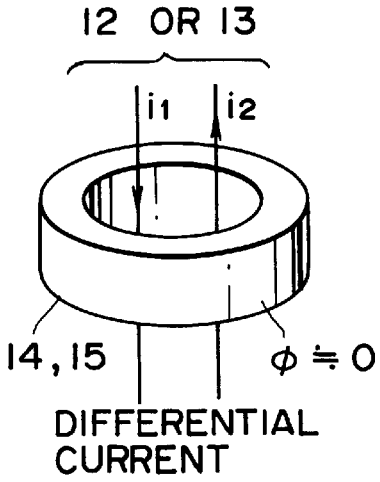

In case data and a strobe pulse are respectively transmitted by the drivers 161 and 171 instead of a common mode, current in an opposite phase respectively flows in the two conductors of the signal conductor as shown in FIG. 5B and a magnetic flux is hardly generated in the ferrite beads 14 and 15, the ferrite beads 14 and 15 have no particular effect upon data transmission.

Figure 6B:
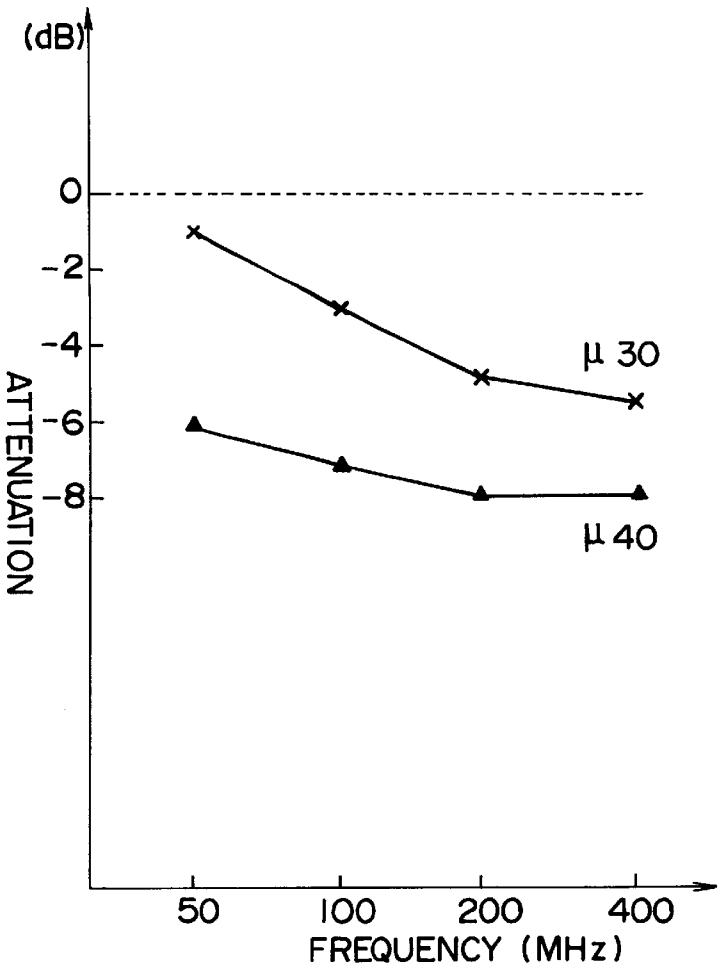
FIGS. 6A and 6B show an example of the frequency characteristic of far-end crosstalk when a ferrite bead is utilized.
Figure 6A:
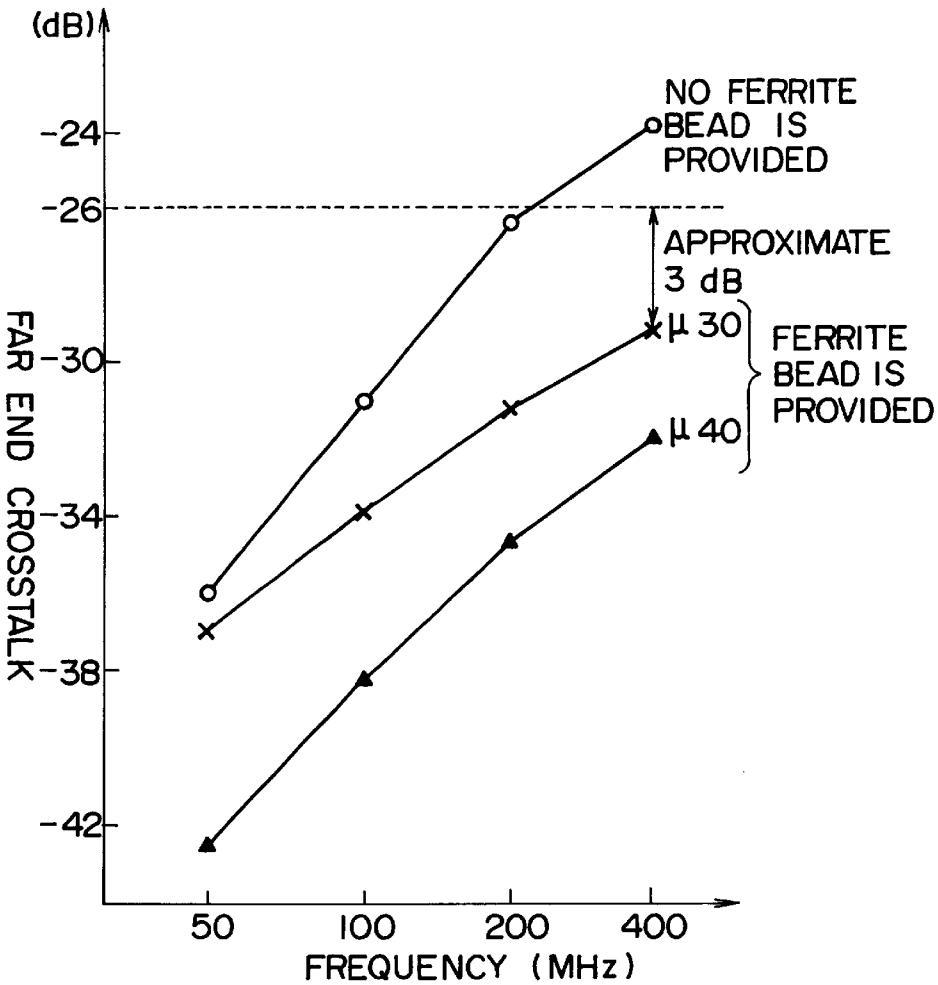

FIGS. 6A and 6B show an example of the frequency characteristic of far-end crosstalk (crosstalk in a device on the side of receiving) of the case in which a ferrite bead the inside diameter of which is 1.5 mm, the outside diameter of which is 3.5 mm and the length of which is 5 mm is provided to each signal conductor 12 or 13 in the plug part of the cable 2 the length of which is 3 m.

As the loss factor tan $\delta(=\mu''/\mu'$, complex magnetic permeability $\mu=\mu'-j\ .\ \mu'')$ of the ferrite bead is increased in a high-frequency area in case the ferrite bead is provided as described above, the attenuation of far-end crosstalk is increased in a high-frequency band as shown in FIG. 6B and far-end crosstalk can be inhibited in a high-frequency band as shown in FIG. 6A so that it is lower than a reference value (−26 dB) determined in the standard. Therefore, crosstalk caused due to a high-frequency component when d.c. current rushes in speed signaling processing for example can be inhibited.

"$\mu$30" and "$\mu$40" shown in FIG. 6A show the type of ferrite beads used "$\mu$30" shows a ferrite bead the initial magnetic permeability of which is 45 and "40" shows a ferrite bead the initial magnetic permeability of which is 120. For example, ferrite beads manufactured by TDK can be used for these ferrite beads.

Figure 7:
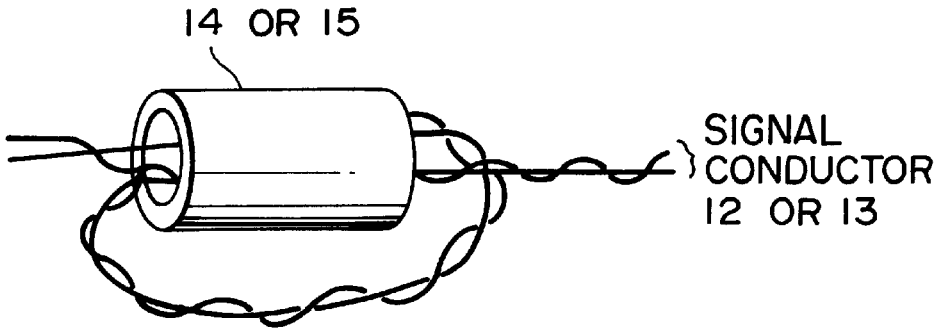
FIG. 7 is a perspective view showing an example of a state when a signal conductor is wound around a ferrite bead.

In the above embodiments, each individual ferrite bead 14 and 15 is provided to each signal conductor 12 or 13, however, as shown in FIG. 7, each signal conductor 12 or 13 may be also wound around each ferrite bead 14 or 15.

In the above embodiments, the ferrite beads 14 and 15 are respectively provided to the signal conductors 12 and 13 of each cable 1 or 2, however, as described below, a ferrite bead may be also provided between the connection (socket) of a device to which the cable is connected and a circuit of a TPA interface and a TPB interface.

Figure 8:
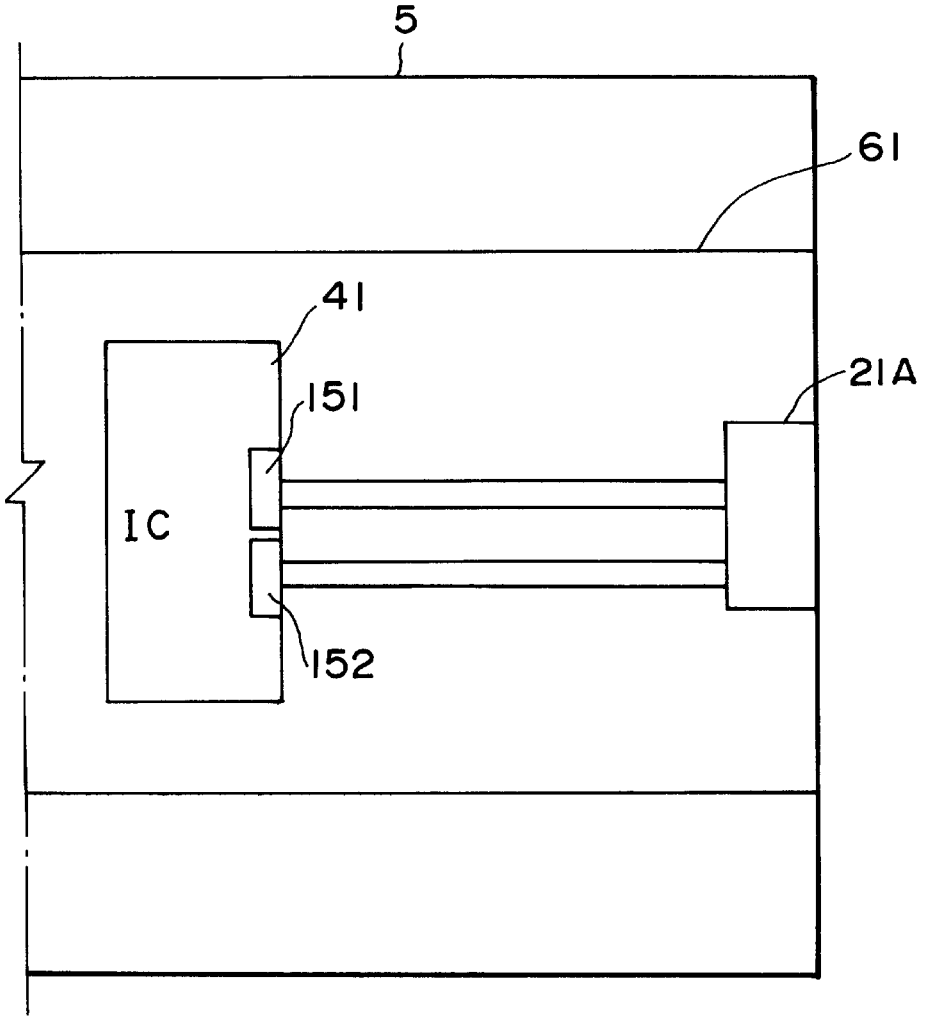
FIG. 8 is a block diagram showing the constitution of a first embodiment of a communication device according to the present invention.

FIG. 8 shows the constitution of a first embodiment of a communication device according to the present invention. In the communication device 5, a socket 21A (connection means) is provided with a joint not shown to which a conventional type IEEE-1394 cable is connected and which is electrically connected to the joint at the end of the cable. A signal supplied via the joint is supplied to an IC 41 which is an interface according to the IEEE-1394 standard via the socket 21A and a printed board 61.

Figure 9A:
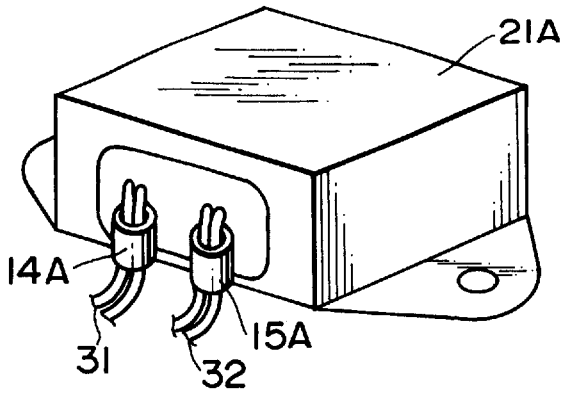
FIGS. 9A and 9B are perspective views showing an example of a socket in the first embodiment.

FIG. 9A shows an example of the socket 21A in which ferrite beads 14A and 15A (closed magnetic circuit means) are respectively provided to lead parts 31 and 32 corresponding to each signal conductor 12 or 13 in the cable. Crosstalk is inhibited as in the above cables 1 and 2 by providing the ferrite beads 14A and 15A to the socket 21A as described above.

Figure 9B:
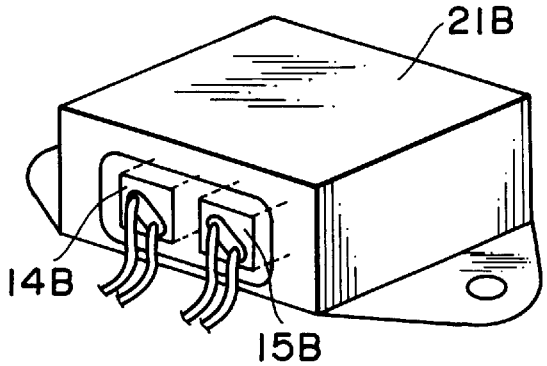

A socket 21B (connection means) shown in FIG. 9B in which parts 14B and 15B (closed magnetic circuit means) provided with high magnetic permeability are embedded around each conductor corresponding to each signal conductor 12 or 13 may be also used in place of the socket 21A.

The integrated circuit (IC) 41 is provided with circuits corresponding to a physical layer part (PHY) such as the TPA interface and the TPB interface and provided with circuits respectively corresponding to the other part of the interfaces according to the IEEE-1394 standard.

Next, a second embodiment of the communication device according to the present invention will be described. In the second embodiment, the ferrite beads 14A and 15A of the socket 21A in the first embodiment are removed and provided to the corresponding parts of the IC 41.

Figure 10A:
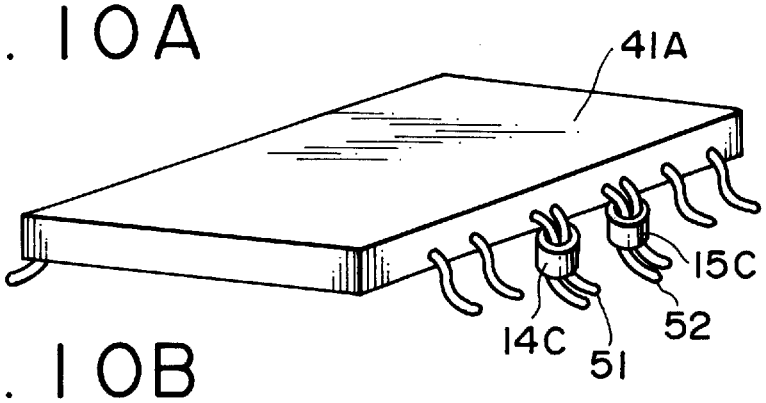
FIGS. 10A and 10B are perspective views showing an example an IC in a second embodiment of the communication device.

FIG. 10A shows an IC 41A (processing means) in this embodiment provided with the circuits of the TPA interface 151 and the TPB interface 152. In the IC 41A, ferrite beads 14C and 15C (closed magnetic circuit means) are respectively provided to the lead parts 51 and 52 corresponding to each signal conductor 12 or 13 of a cable.

Crosstalk is inhibited as in the above cables 1 and 2 by respectively providing the ferrite beads 14C and 15C provided with high magnetic permeability to the lead parts 51 and 52 of the IC 41A as described above.

Figure 10B:
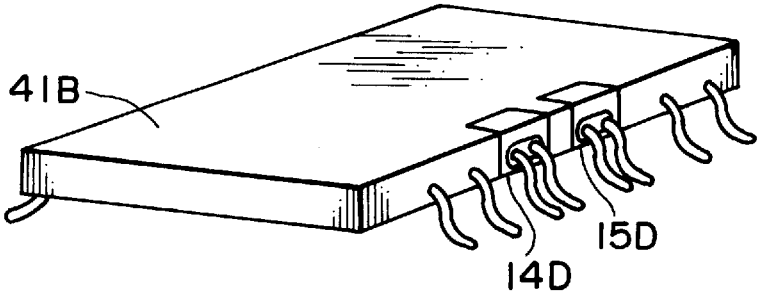

An IC 41B (processing means) in which material 14D or 15D (closed magnetic circuit means) provided with high magnetic permeability is respectively embedded around conductors corresponding to each signal conductor 12 or 13 as shown in FIG. 10(B) may be also used in place of the IC 41A.

Next, a third embodiment of the communication device according to the present invention will be described. In the third embodiment, the ferrite beads 14A and 15A of the socket 21A in the first embodiment are removed and are respectively provided to conductors in the printed board 61.

Figure 11:
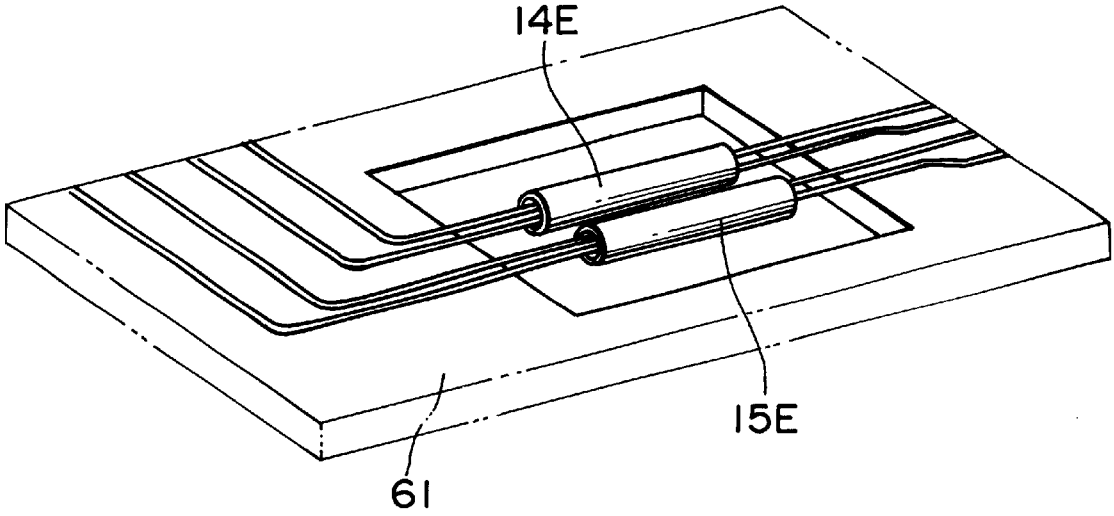
FIG. 11 is a perspective view showing an example of a printed board 61 in a third embodiment of the communication device.

FIG. 11 shows an example in which ferrite beads 14E and 15E (closed magnetic circuit means) are respectively provided to two conductors corresponding to each signal conductor 12 or 13 between a socket to which a cable is connected and the circuit (the IC 41) of the TPA interface 151 and the TPB interface 152 on the printed board 61.

Crosstalk is inhibited as in the above cables 1 and 2 by providing the ferrite beads 14E and 15E on the printed board 61 as described above.

As described above, crosstalk is inhibited by respectively providing parts provided with high magnetic permeability constituting a closed magnetic circuit around conductors corresponding to each signal conductor 12 or 13 between the socket to which a cable is connected and the circuit of the TPA interface 151 and the TPB interface 152.

Figure 24:
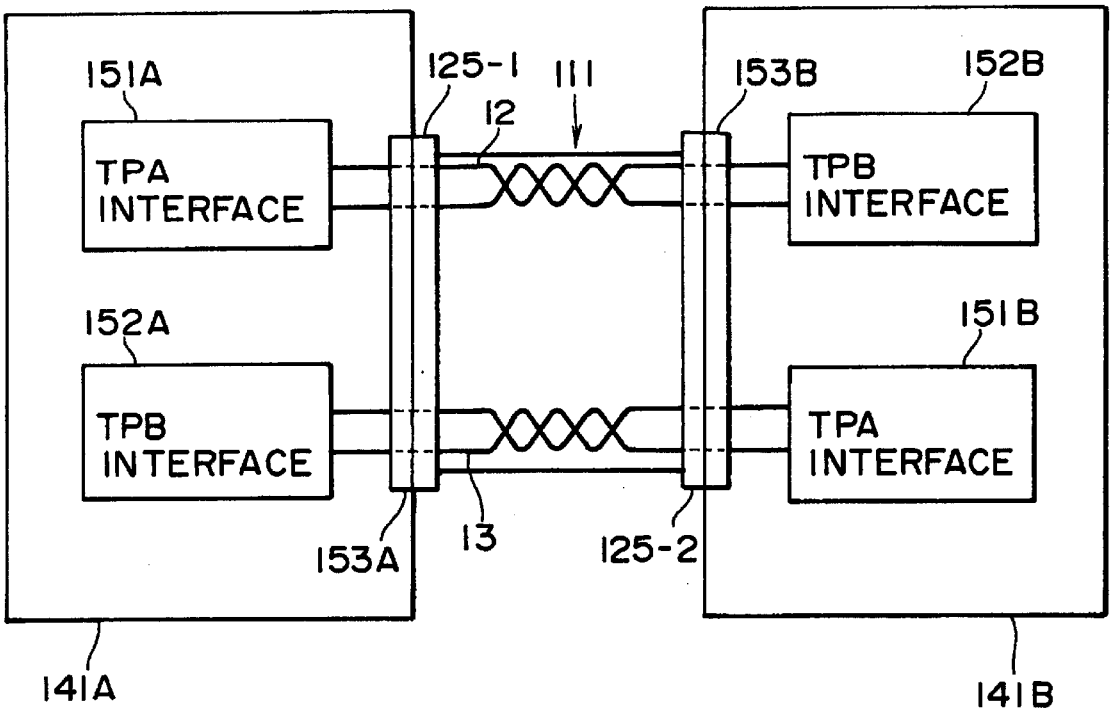
FIG. 24 (PRIOR ART)
FIG. 24 is a block diagram showing an example of the connection of two of the devices shown in FIG. 23.

As the operation of the above communication device in the first to third embodiments is the same as that of the above devices 141A and 141B shown in FIG. 24, the description is omitted. However, as parts provided with high magnetic permeability such as a ferrite bead are provided as described above, crosstalk is inhibited in the first to third embodiments.

In the above embodiments, ferrite is utilized for material provided with high magnetic permeability, however, another material may be also utilized.

Figure 12:
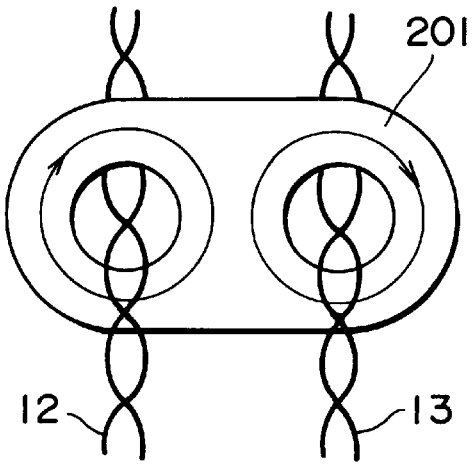
FIG. 12 shows the constitution for the case in which a ferrite bead is integrated.

The shape of the ferrite bead used is not limited to the above one. In the above embodiments, independent parts (the ferrite beads 14 and 15, 14A and 15A, 14C and 15C, 14E and 15E) are provided to each pair of two pairs of signal conductors, however, these parts may be also integrated as a ferrite bead 201 as shown in FIG. 12 for example to be a part for reducing the cost and enhancing mechanical strength. In an example shown in FIG. 12, independent holes are respectively made in the ferrite bead 201 for the signal conductor 12 and for the signal conductor 13 and the signal conductor 12 or 13 is inserted into the hole. Hereby, the respective magnetic paths of signal conductors 12 and 13 are formed substantially independently and mutual interference, therefore, crosstalk is reduced.

Figure 13:
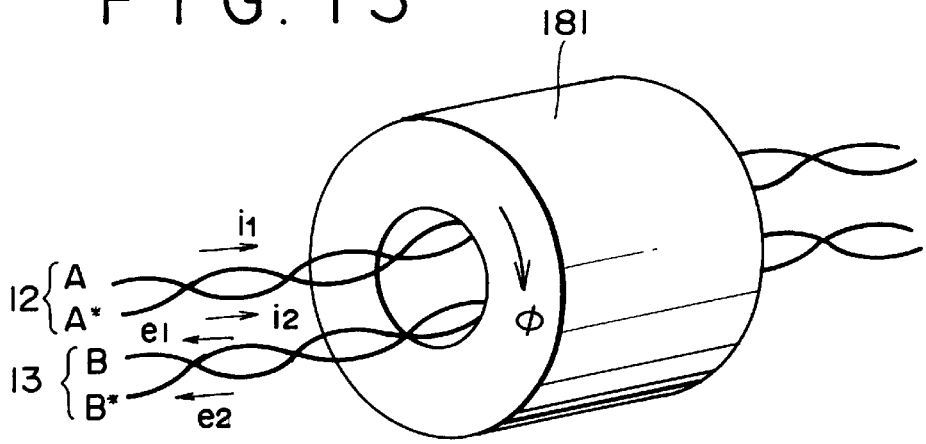
FIG. 13 is a perspective view showing an example the shape and the arrangement of a ferrite bead in which crosstalk between signal conductors is increased.

In the meantime, as shown in FIG. 13, it is also conceivable that two pairs of signal conductors 12 and 13 are inserted into one hole of a ferrite bead 181, however, in this case, as the respective magnetic paths are not independent, magnetic fluxes interlinked with the other signal conductor of magnetic fluxes generated in one signal conductor are increased and crosstalk is increased, it is undesirable that the ferrite bead 181 is provided to two pairs of signal conductors 12 and 13 as described above.

Figure 14:
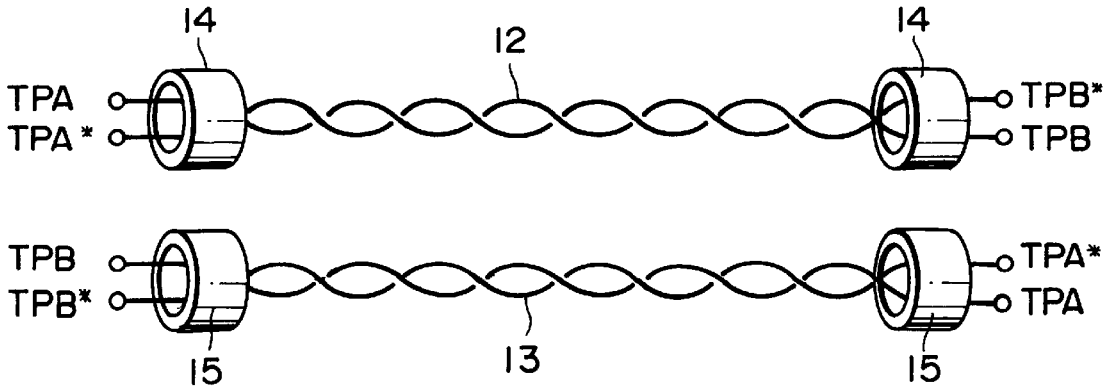
FIG. 14 explains the position of ferrite beads on signal conductors.
Figure 15:
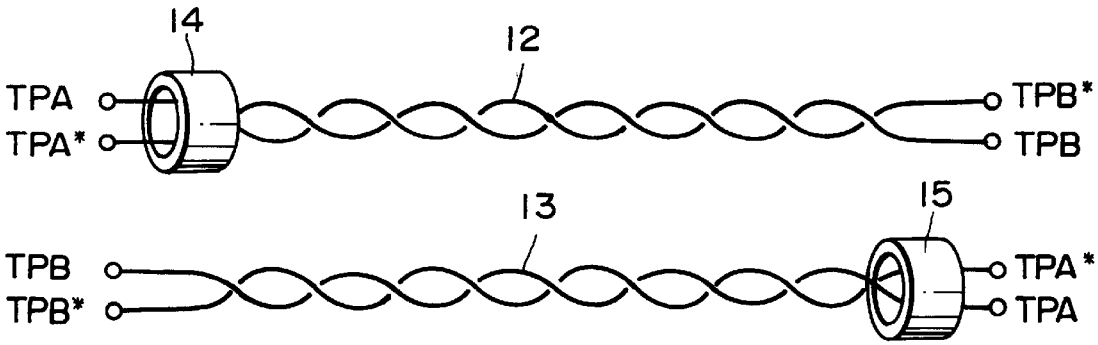
FIG. 15 explains the position of ferrite beads on signal conductors.
Figure 16:
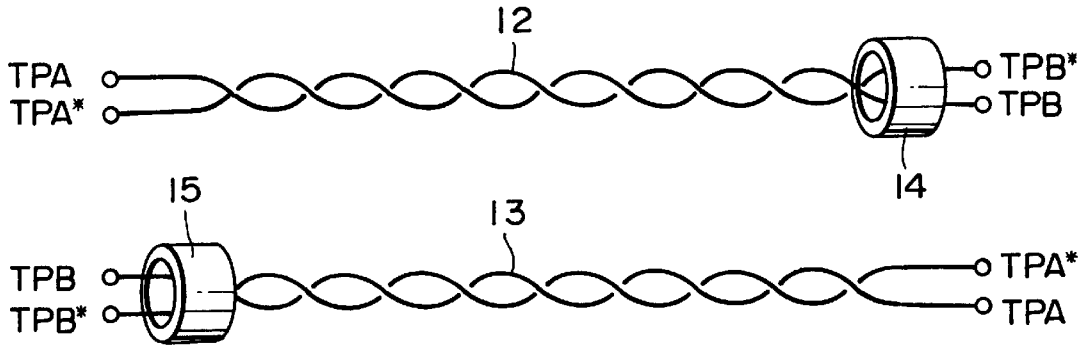
FIG. 16 explains the position of ferrite beads on signal conductors.

In the above embodiments, in case the number of pins is both 4 and 6, as shown in FIG. 14, ferrite beads 14 are arranged at both ends of the signal conductor 12 and ferrite beads 15 are arranged at both ends of the signal conductor 13, however, as shown in FIG. 15 for example, the ferrite bead 14 may be also arranged only on the side of the TPA interface 151A of the signal conductor 12 and the ferrite bead 15 may be also arranged only on the side of the TPA interface 151B of the signal conductor 13 or as shown in FIG. 16, the ferrite bead 14 maybe also arranged only on the side of the TPB interface 152B of the signal conductor 12 and the ferrite bead 15 may be also arranged only on the side of the TPB interface 152A of the signal conductor 13. In the constitutions shown in FIGS. 15 and 16, the effect of inhibiting crosstalk is reduced, compared with that in the constitution shown in FIG. 14, however, crosstalk can be inhibited more, compared with a case that no ferrite bead is inserted. In case two ferrite beads cannot be arranged when a connector plug is miniaturized, the above constitutions are particularly effective.

This is also similar in case the ferrite beads 14A and 15A, 14C and 15C and 14E and 15E are formed.

Figure 17:
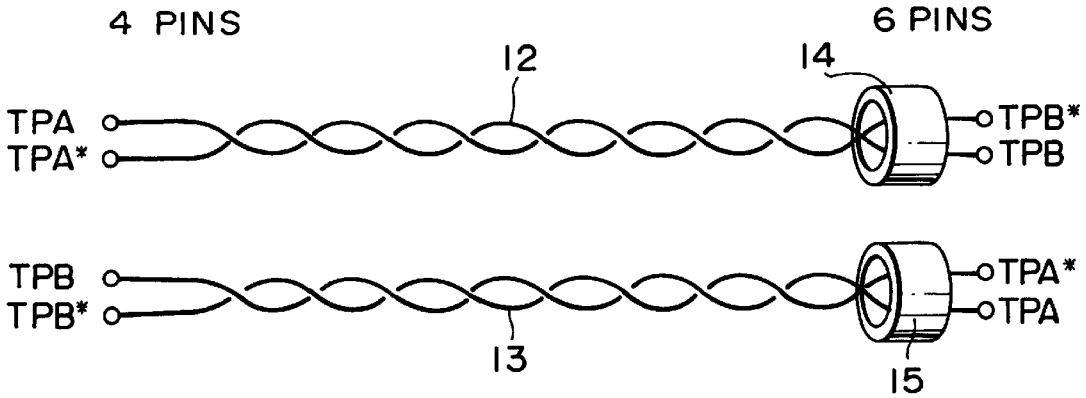
FIG. 17 explains the position of ferrite beads on signal conductors.
Figure 18:
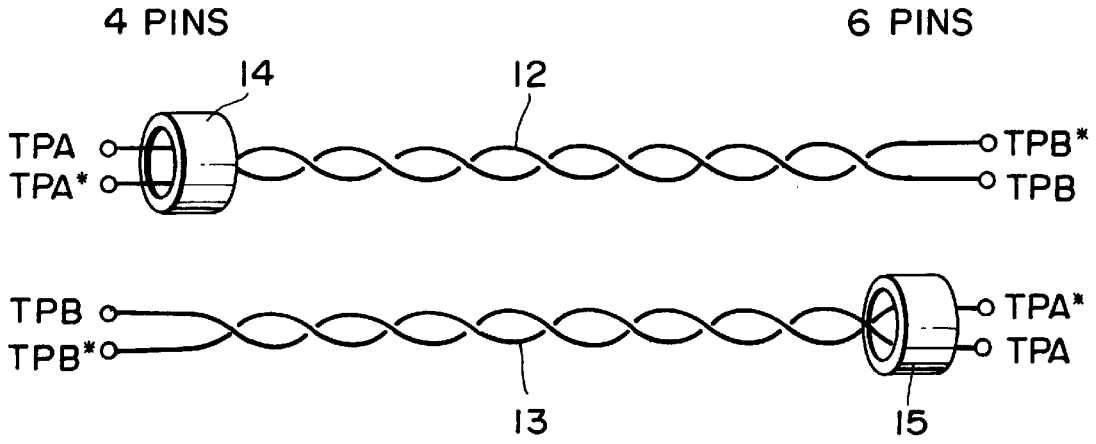
FIG. 18 explains the position of ferrite beads on signal conductors.
Figure 19:
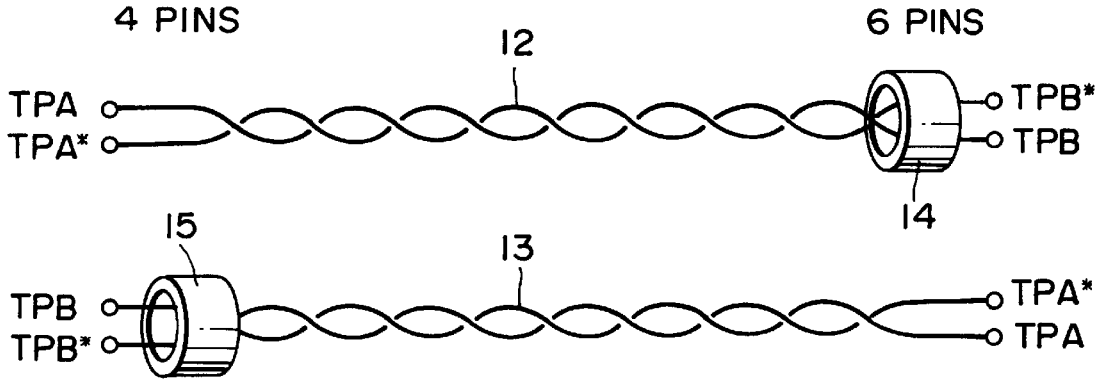
FIG. 19 explains the position of ferrite beads on signal conductors.

FIGS. 17 to 19 show an example of the arrangement of ferrite beads in case the number of pins of one terminal is 4 and the number of pins of the other terminal is 6. In this case, in addition to constitution (in this case, crosstalk can be most effectively inhibited) in which the ferrite beads 14 or the ferrite beads 15 are arranged at both ends of each signal conductor 12 or 13 as shown in FIG. 14, the ferrite bead 14 or the ferrite bead 15 may be arranged only on each 6-pin side of the signal conductors 12 and 13 as shown in FIG. 17, the ferrite bead 14 may be arranged only on the 4-pin side of the signal conductor 12 and the ferrite bead 15 may be arranged only on the 6-pin side of the signal conductor 13 as shown in FIG. 18, or the ferrite bead 14 may be arranged only on the 6-pin side of the signal conductor 12 and the ferrite bead 15 may be arranged only on the 4-pinside of the signal conductor 13 as shown in FIG. 19. In the above cases, the effect of inhibiting crosstalk is a little reduced, compared with a case that the ferrite beads 14 or the ferrite beads 15 are arranged at both ends of the signal conductor 12 or 13, however, crosstalk can be inhibited, compared with a case that no ferrite bead are provided.

Figure 20:
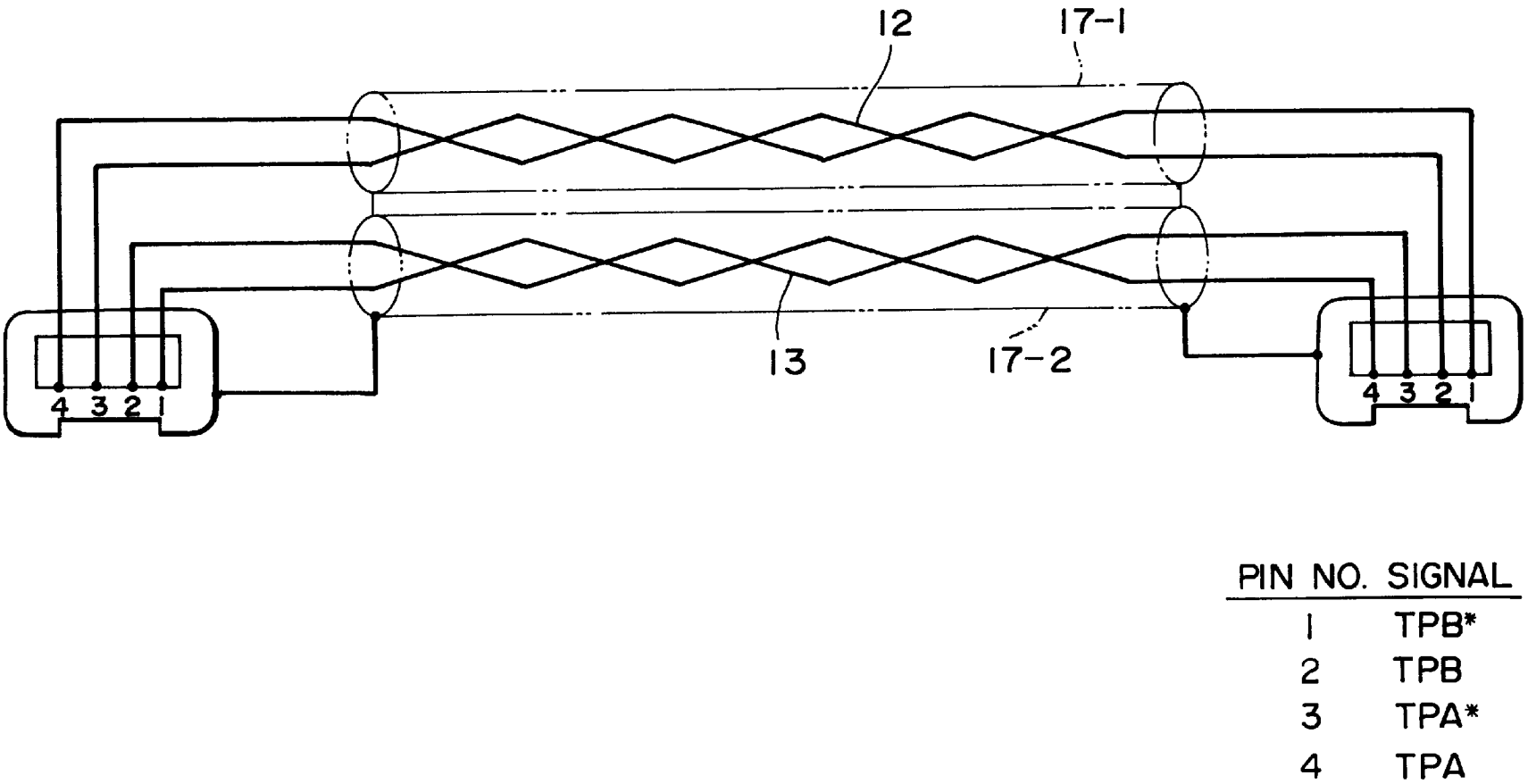
FIG. 20 shows the constitution for the case in which the number of pins at each end of signal conductors is four.
Figure 21:
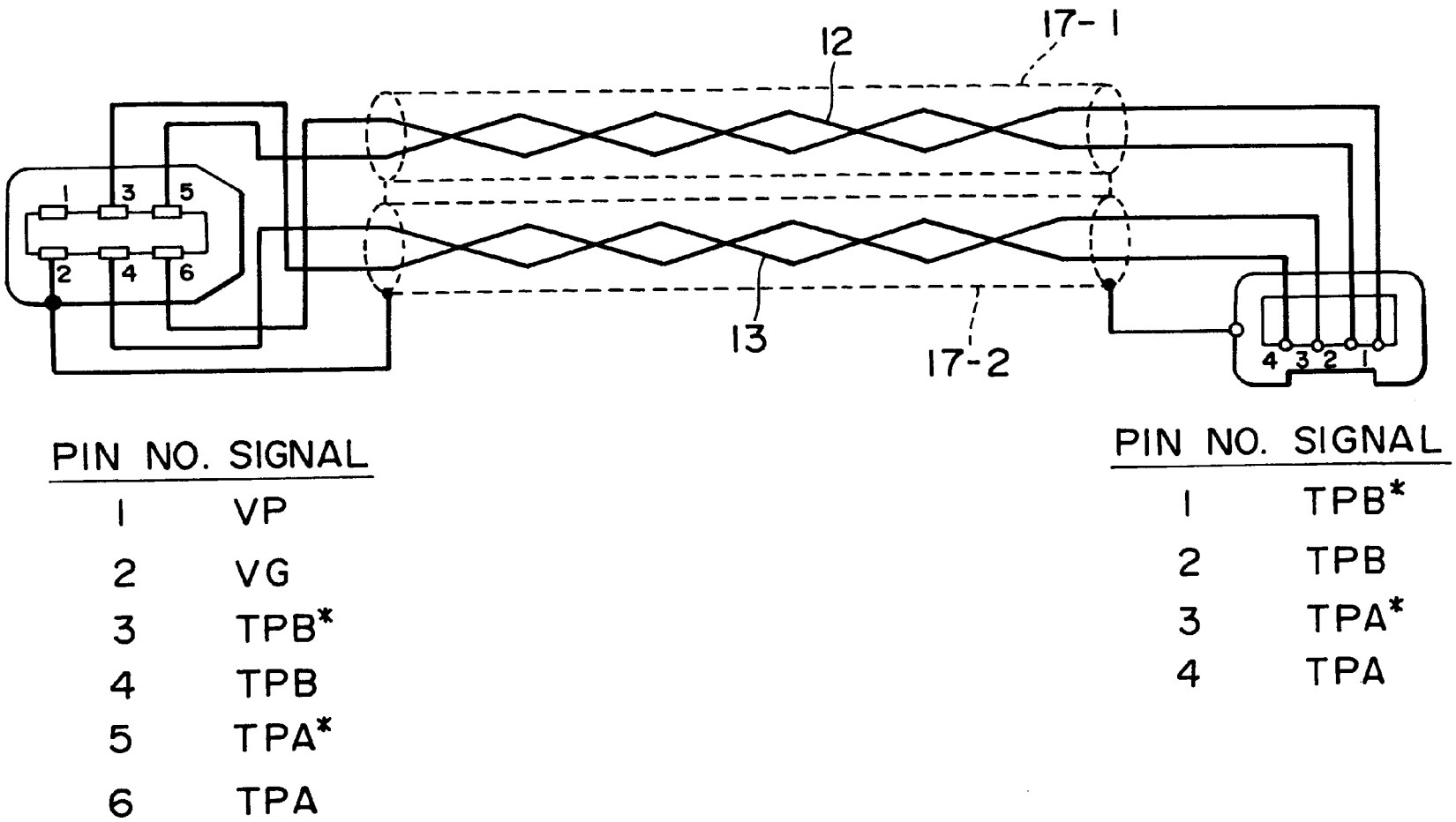
FIG. 21 shows the constitution for the case in which the number of pins at one end of signal conductors is four and the number of pins at the other end is six.
Figure 22:
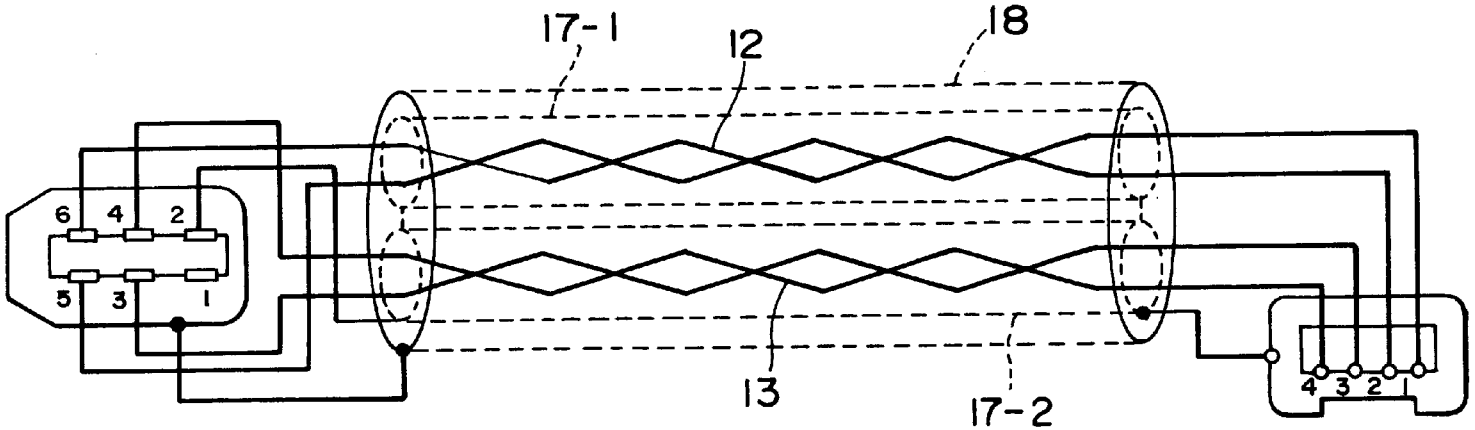
FIG. 22 shows the constitution for the case in which the number of pins at one end of signal conductors is four and the number of pins at the other end is six.
Figure 23:
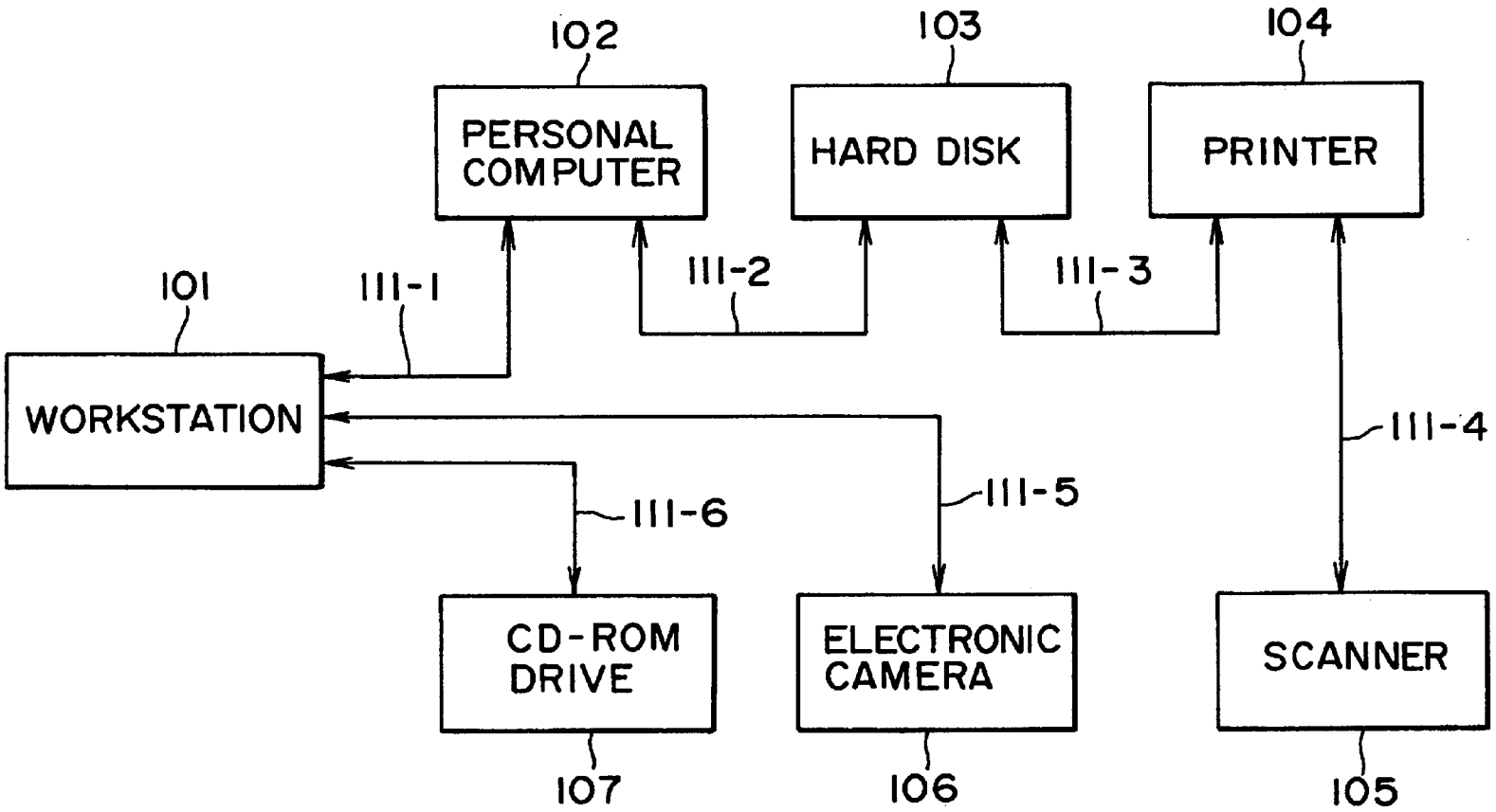
FIG. 23 (PRIOR ART)
FIG. 23 is a block diagram showing an example of an information processing system connected utilizing a cable according to the IEEE-1394 standard.

In case the both ends of the signal conductors 12 and 13 are respectively constituted by four pins, the signal conductors 12 and 13 are respectively shielded by signal conductor shields 17-1 and 17-2 as shown in FIG. 20, in the meantime, in case one end of the signal conductors 12 and 13 is constituted by four pins and the other end is constituted by six pins, the signal conductors are constituted as shown in FIG. 21 or 22. In FIGS. 20 and 21, no ferrite bead is shown.

Figure 25:
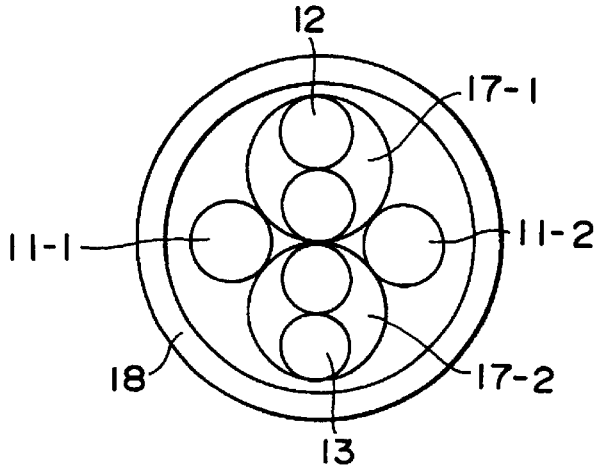
FIG. 25 (PRIOR ART)
FIG. 25 is a sectional view showing an example of the cable according to the IEEE-1394 standard.
Figure 26:
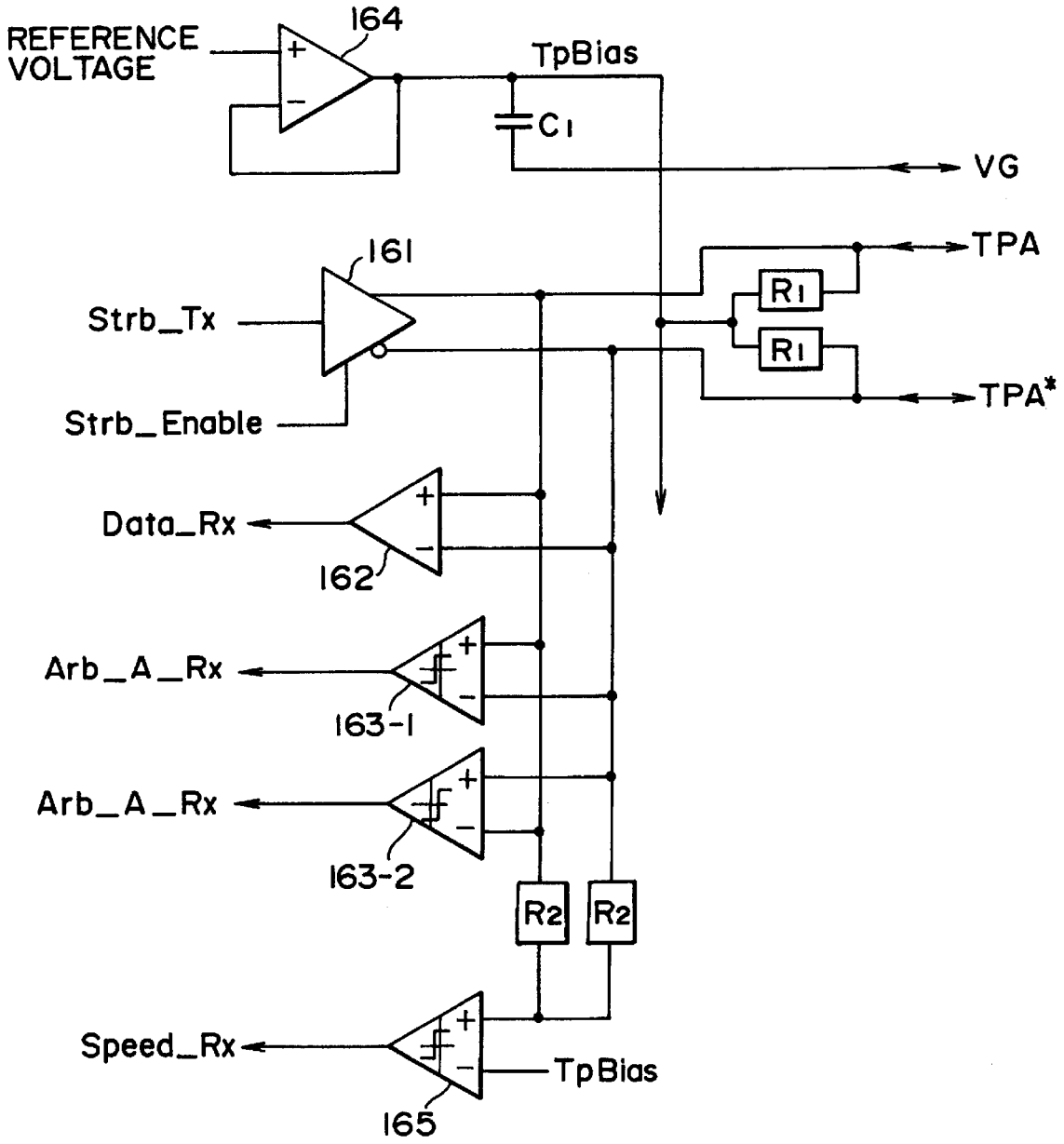
FIG. 26 (PRIOR ART)
FIG. 26 is a circuit diagram showing an example of the constitution the TPA interface shown in FIG. 24.
Figure 27:
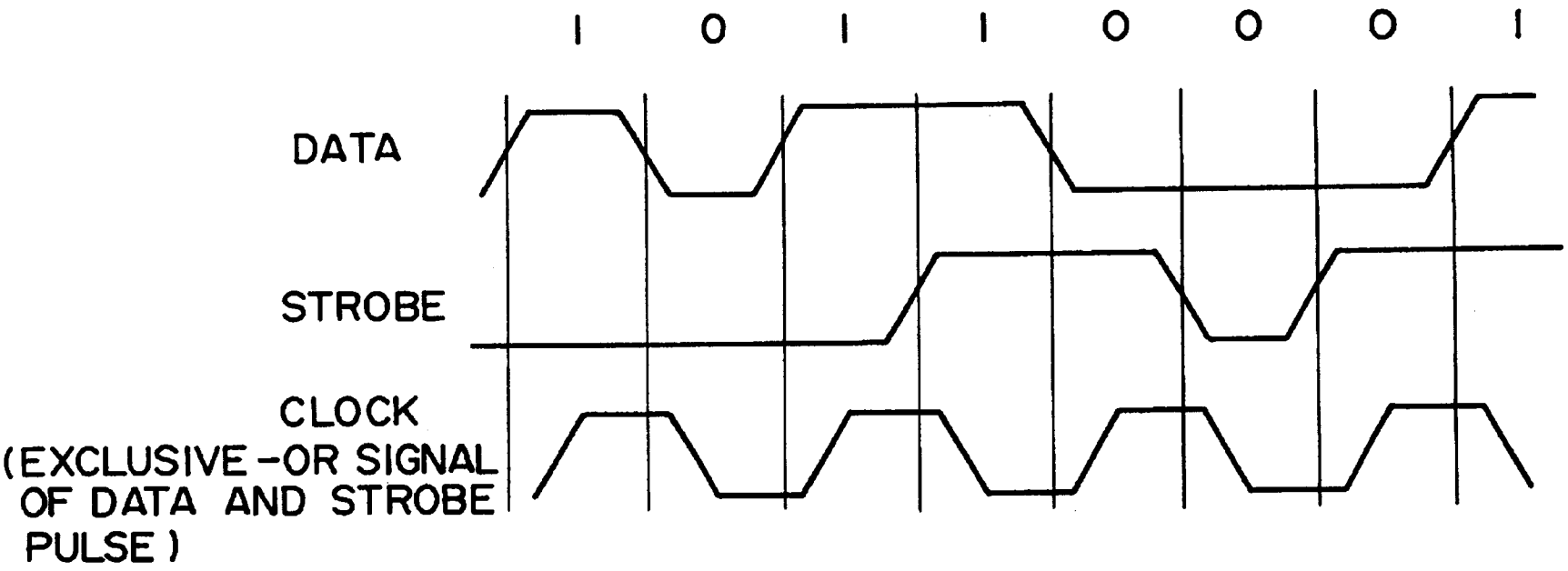
FIG. 27 (PRIOR ART)
FIG. 27 explains a DS linking system.
Figure 28:
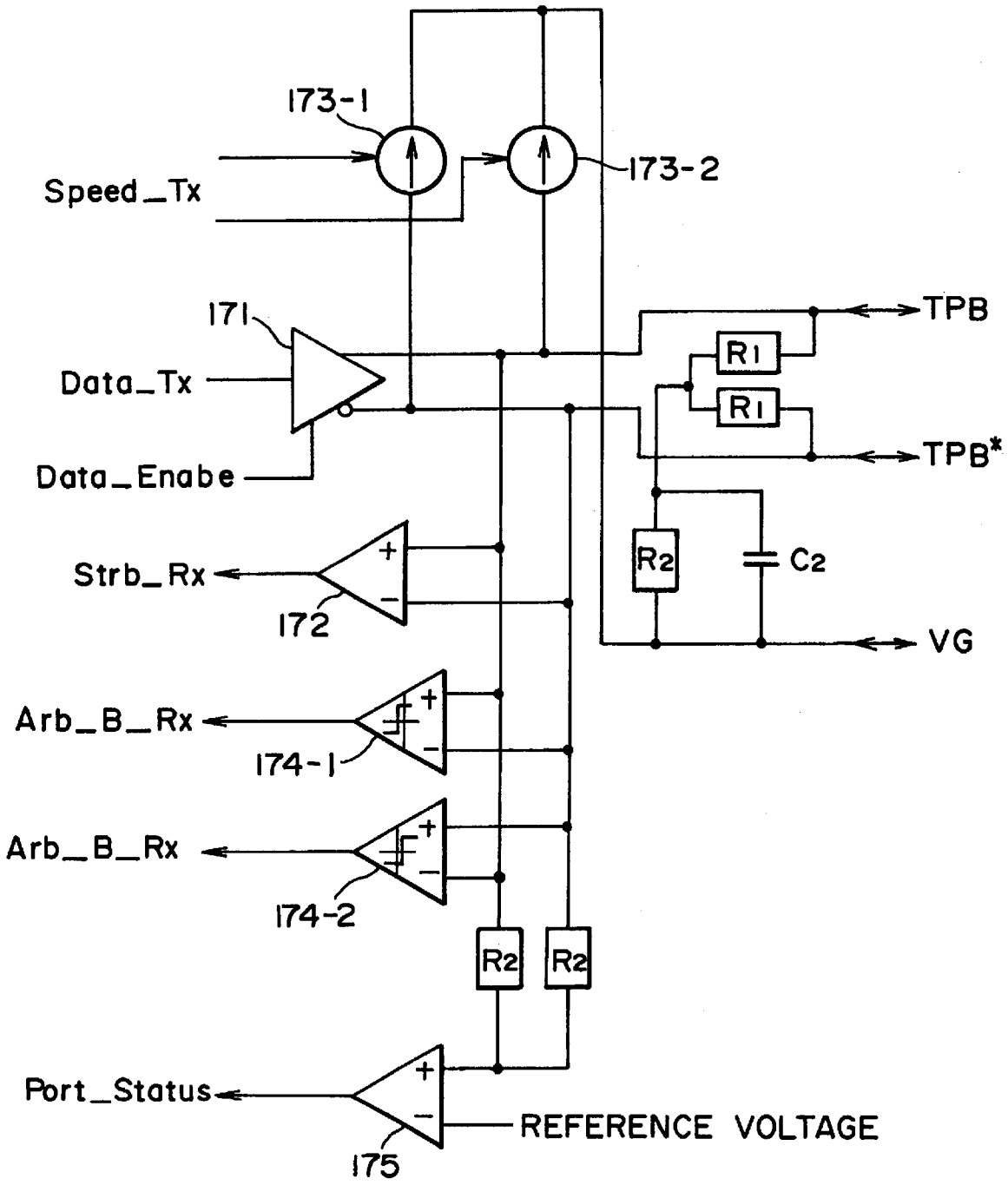
FIG. 28 (PRIOR ART)
FIG. 28 is a circuit diagram showing an example of the constitution of the TPB interface shown in FIG. 24.

In the example of the constitution shown in FIG. 21, the signal conductor shields 17-1 and 17-2 are connected to a pin No. 2 on the 6-pin side and grounded, and a pin No. 1 is open. In the example shown in FIG. 22, the inside of the signal conductor shields 17-1 and 17-2 is connected to a pin No. 2 on the 6-pin side and grounded. A pin No. 1 is open. Further, as a variation of FIG. 25, an insulator may be also inserted between a cable whole shield 18 and the signal conductor shield 17-1 or 17-2 inside the cable whole shield.

As described above, according to a connecting cable disclosed in claim 1, as a signal is transmitted via a signal conductor interlinked with closed magnetic circuit means in which a closed magnetic circuit is formed by material provided with predetermined magnetic reluctance and high magnetic permeability, crosstalk between signal conductors in a common mode can be inhibited.

According to a communication device disclosed in claim 8 and a communication method disclosed in claim 11, as communication is made via a connection provided with a closed magnetic circuit part in which an independent closed magnetic circuit interlinked with two conductors corresponding to each signal conductor is formed by material provided with predetermined magnetic reluctance and high magnetic permeability, crosstalk between signal conductors in a common mode can be inhibited.

According to a communication device disclosed in claim 12 and a communication method disclosed in claim 15, as communication processing is executed by a processing section provided with a closed magnetic circuit part in which an independent closed magnetic circuit interlinked with two conductors corresponding to each signal conductor is formed by material provided with predetermined magnetic reluctance and high magnetic permeability, crosstalk between signal conductors in a common mode can be inhibited.

According to a communication device disclosed in claim 16 and a communication method disclosed in claim 19, as a closed magnetic circuit part in which an independent closed magnetic circuit interlinked with two conductors corresponding to each signal conductor for connecting a connection and a processing section is formed by material provided with predetermined magnetic reluctance and high magnetic permeability is provided and communication is made via the two conductors, crosstalk between signal conductors in a common mode can be inhibited.

What is claimed is:

1. A connecting cable provided with at least two pairs of signal conductors, each pair provided with two conductors, said connecting cable having a cable part in which said two pairs of signal conductors are shielded, and plug part for connecting the cable to another device, said connecting cable further comprising:

closed magnetic circuit means disposed in said plug part and having an independent closed magnetic circuit for respectively interlinking each pair of signal conductors independently; and wherein said closed magnetic circuit means is formed of material having a predetermined magnetic reluctance and high magnetic permability.

2. A connecting cable according to claim 1, wherein:

said connecting cable complies with the IEEE-1394–1995 serial bus standard.

3. A connecting cable according to claim 1, wherein:

each said pair of signal conductors is a twisted pair.

4. A connecting cable according to claim 1, wherein:

said closed magnetic circuit means is a pair of ferrite beads, with each ferrite bead surrounding a respective pair of signal conductors to produce a closed magnetic circuit interlinking the respective signal conductor pair.

5. A connecting cable according to claim 1, wherein:

said closed magnetic circuit means is arranged at both ends of each pair of signal conductors.

6. A connecting cable according to claim 1, wherein:

said closed magnetic circuit means is arranged only at one end of each pair of signal conductors.

7. A connecting cable according to claim 1, wherein:

said closed magnetic circuit means is integrated so that each pair of signal conductors passes through a different hole of said material.

8. A communication device provided with connection means connected to a connecting cable provided with at least two pairs of signal conductors each pair provided with two conductors and processing means for processing a signal to be sent or received via said connection means and said connecting cable, comprising:

a closed magnetic circuit part, disposed within said connection means, having an independent closed magnetic circuit interlinking two conductors of the device corresponding to each pair of signal conductors independently; and wherein said independent closed magnetic circuit is formed of material having a predetermined magnetic reluctance and high magnetic permeability.

9. A communication device according to claim 8, wherein:

said connection means is a connecting socket according to the IEEE-1394–1995 serial bus standard.

10. A communication device according to claim 8, wherein:

said material provided with high magnetic permeability is ferrite.

11. A communication method for processing a signal to be sent or received via a connection connected to a connecting cable provided with a least two pairs of signal conductors, each pair provided with two conductors, said connecting cable having a cable part in which said two pairs of signal conductors are shielded, and a plug part for connecting the cable to another device, said method comprising the steps of:

providing a closed magnetic circuit part within said plug part in which an independent closed magnetic circuit is interlinked with two conductors of said plug part corresponding to each of said pair of signal conductors;

providing said independent closed magnetic circuit with predetermined magnetic reluctance and high magnetic permeability; and communicating a signal through said conductors interlinked by said closed magnetic circuit.

12. A communication device provided with connection means connected to a connecting cable provided with at least two pairs of signal conductors each pair provided with two conductors and processing means for processing a signal to be sent or received via said connection means and said connecting cable, wherein:

said processing means is provided with a closed magnetic circuit part having an independent closed magnetic circuit interlinking two conductors of said device corresponding to each pair of signal conductors independently; and wherein said closed magnetic circuit means is formed of material having a predetermined magnetic reluctance and high magnetic permeability.

13. A communication device according to claim 12, wherein:

said processing means processes a signal of a format according to the IEEE-1394–1995 serial bus standard.

14. A communication device according to claim 12, wherein:

said material provided with high magnetic permeability is ferrite.

15. A communication method in which a signal to be sent or received via a connecting cable provided with at least two pairs of signal conductors, each pair provided with two conductors, is processed by a predetermined processing section, comprising the steps of:

processing said signal through said processing section provided with a closed magnetic circuit part having an independent closed magnetic circuit interlinking two conductors of said processing section corresponding to each pair of signal conductors; and forming said closed magnetic circuit part by a material provided with predetermined magnetic reluctance and high magnetic permeability.

16. A communication device provided with a connection connected to a connecting cable provided with at least two pairs of signal conductors each pair provided with two conductors and a processor for processing a signal to be sent via said connection and said connecting cable, comprising:

a closed magnetic circuit part provided in said connection, in which an independent closed magnetic circuit interlinks two conductors of said device corresponding to each pair of signal conductors connecting said connection and said processor;

wherein said closed magnetic circuit is formed by material provided with predetermined magnetic reluctance and high magnetic permeability.

17. A communication device according to claim 16, wherein:

said processor processes a signal of a format according to the IEEE-1394–1995 serial bus standard.

18. A communication device according to claim 16, wherein:

said material provided with high magnetic permeability is ferrite.

19. A communication method in which a signal to be sent or received via a connection connected to a connecting cable provided with at least two pairs of signal conductors, each pair provided with two conductors, is processed by a predetermined processing section, comprising the steps of:

forming a closed magnetic circuit part within said connection, having an independent closed magnetic circuit interlinking two conductors within said connection corresponding to each pair of signal conductors;

connecting said connection and said processing section;

forming said closed magnetic circuit part by a material provided with predetermined magnetic reluctance and high magnetic permeability; and communicating said signal via said signal conductors.

20. A connecting cable provided with at least two pairs of signal conductors, each pair provided with two conductors, said connecting cable having a cable part in which said two pairs of signal conductors are shielded, and a plug part for connecting the cable to another device, said connecting cable further comprising:

a closed magnetic circuit portion disposed in said plug part and having an independent closed magnetic circuit respectively interlinking each pair of signal conductors independently; and wherein said closed magnetic circuit portion is formed of material having a predetermined magnetic reluctance and high magnetic permeability.

21. A connecting cable according to claim 20, wherein said connecting cable complies with the IEEE-1394–1995 serial bus standard.

22. A connecting cable according to claim 20, wherein each said pair of signal conductors is a twisted pair.

23. A connecting cable according to claim 20, wherein each said closed magnetic circuit portion is a pair of ferrite beads, with each ferrite bead surrounding a respective pair of signal conductors to produce a closed magnetic circuit interlinking the respective signal conductor pair.

24. A connecting cable according to claim 20, wherein said closed magnetic circuit portion is arranged at both ends of each pair of signal conductors.

25. A connecting cable according to claim 20, wherein said closed magnetic circuit portion is arranged only at one end of each pair of signal conductors.

26. A connecting cable according to claim 20, wherein said closed magnetic circuit portion is integrated so that each pair of signal conductors passes through a different hole of said material.

* * * * *